United States Patent [19]

Miller

[11] Patent Number: 4,524,691

[45] Date of Patent: Jun. 25, 1985

[54] ENVELOPE FEEDER FOR PRINTING PRESS WITH TIMING CIRCUIT FOR SUCTION CUPS, FEED ROLLER AND FLYWHEEL

[75] Inventor: Curtis B. Miller, Plantation, Fla.

[73] Assignee: Graphic Arts Technical Innovators, Inc., Palm Bay, Fla.

[21] Appl. No.: 570,004

[22] Filed: Jan. 11, 1984

[51] Int. Cl.[3] ..... B41F 13/24

[52] U.S. Cl. ..... 101/232; 271/107; 271/93; 271/11

[58] Field of Search ..... 101/232, 233; 400/605, 400/608.2; 271/2, 11, 90, 93, 94, 107, 108

[56] References Cited

U.S. PATENT DOCUMENTS

| | | | |
|---|---|---|---|
| 1,809,495 | 6/1931 | Stromberg et al. | 271/107 X |
| 1,854,221 | 4/1932 | Post . | |
| 2,138,343 | 11/1938 | Durup | 271/12 |
| 2,352,088 | 6/1944 | Evans | 271/9 |
| 2,554,577 | 5/1951 | Lauffer | 271/2 |
| 2,554,578 | 5/1961 | Lauffer | 271/2 |
| 2,883,929 | 4/1959 | Eichenbaum et al. | 271/9 X |
| 2,988,355 | 6/1961 | Rabinow et al. | 271/2 |
| 3,147,978 | 9/1964 | Sjostrand | 271/107 X |
| 3,160,293 | 12/1964 | Hennequin | 214/7 |
| 3,175,822 | 3/1965 | Benson | 271/2 |
| 3,456,816 | 7/1969 | Galloway | 271/107 X |
| 3,635,159 | 1/1972 | Keeler | 271/9 X |
| 3,801,777 | 4/1974 | Onoe et al. | 271/107 X |
| 4,071,234 | 1/1978 | Schick | 271/107 X |
| 4,129,294 | 12/1978 | Marass | 271/93 |
| 4,248,417 | 2/1981 | Fujimoto | 271/107 X |
| 4,402,497 | 9/1983 | Weibel et al. | 271/11 |
| 4,420,150 | 12/1983 | Umezawa | 271/11 |
| 4,436,300 | 3/1984 | Goi | 271/107 |

FOREIGN PATENT DOCUMENTS

| | | | |
|---|---|---|---|
| 132652 | 10/1978 | U.S.S.R. | 101/232 |

*Primary Examiner*—E. H. Eickholt

*Attorney, Agent, or Firm*—Oltman and Flynn

[57] ABSTRACT

An envelope feeder for a printing press providing a unique feeder arrangement that allows multiple parallel feeding of stacks of differently sized and shaped envelopes to be fed into the press simultaneously. An envelope vacuum pick-up arrangement is coordinated with a feed roller that grabs the envelopes from the bottom end of open-ended, independently adjustable feeder trays, that can be fed with unprinted envelopes continuously without interrupting the printing process. Electronic logic sensing and control apparatus monitors the envelope feeding process such that, in case of misfeeds, the next following printing cycle is inhibited to avoid smearing of wet ink. Timing apparatus with manual control insures precise registration of the printed image even at high speed operation. Manual switches coordinated with the electronic control allows feeding from a single or from all feeder trays.

21 Claims, 9 Drawing Figures

FIG. 6
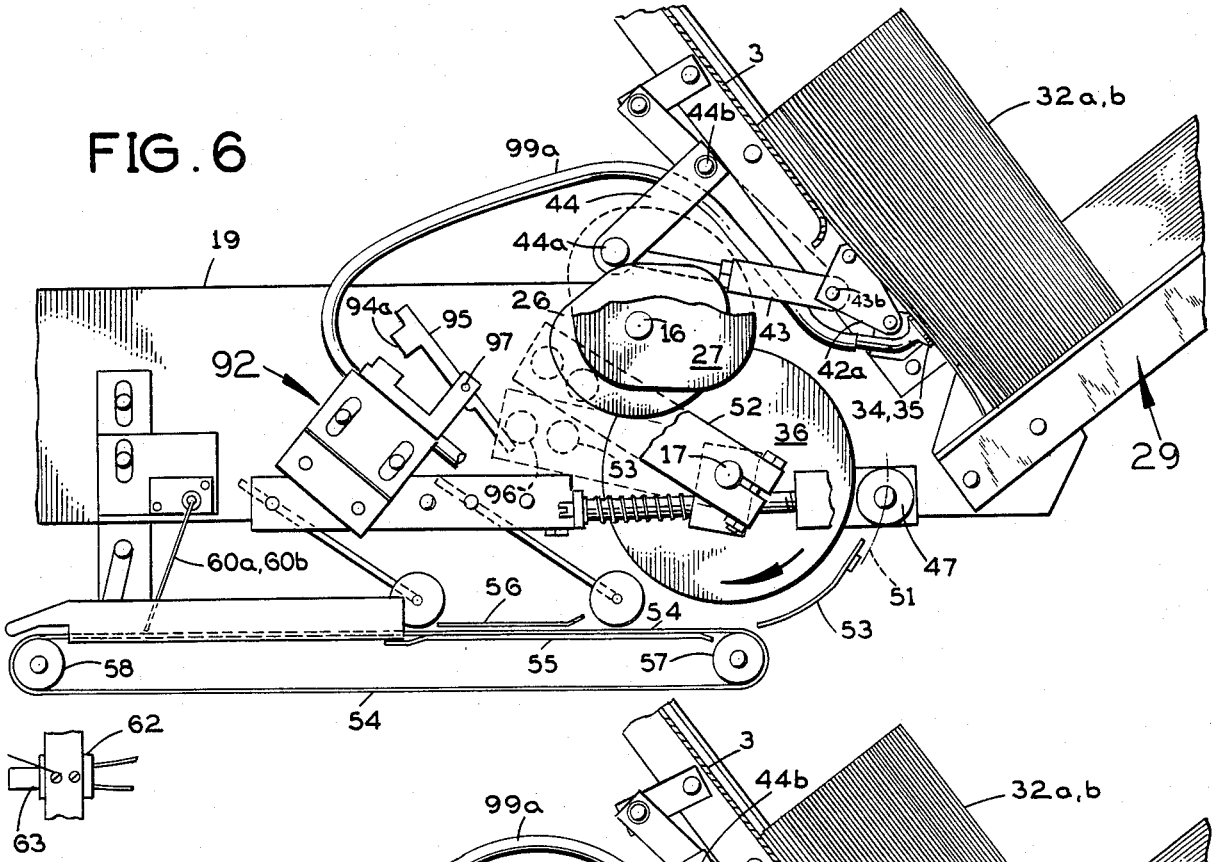
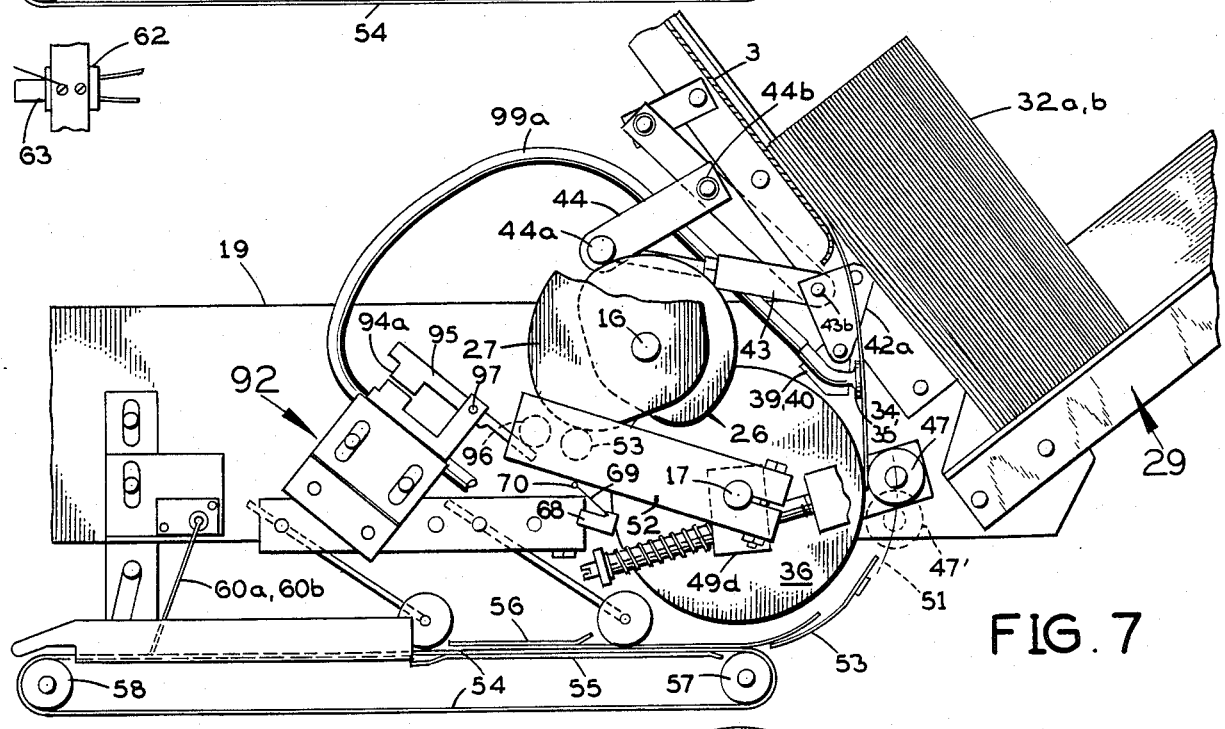
FIG. 7
FIG. 8
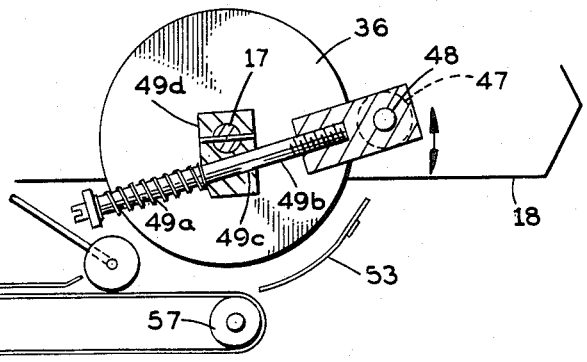

ENVELOPE FEEDER FOR PRINTING PRESS WITH TIMING CIRCUIT FOR SUCTION CUPS, FEED ROLLER AND FLYWHEEL

BACKGROUND AND PRIOR ART

The invention relates to feeding mechanisms for printing presses and more particularly to feeding mechanisms that are suited for feeding envelopes into a high speed printing press.

There is a body of art relating to mechanisms for feeding paper and envelopes to a printing press. Envelopes present a unique problem that relates to the physical configuration of an envelope in that it is composed of two layers of paper and has a hinged flap on one side.

The following references are representative of prior art:

U.S. Pat. No. 3,175,822 Feeding Mechanism for Envelopes H. A. Benson Mar. 30, 1965. Feeding mechanism with conveyor belt, arcuate path to feeding cylinder (withdrawal cylinder), feed control arms. No Vacuum. No multiple feeding capability.

U.S. Pat. No. 3,160,293 Device For Stacking Letters etc. M. Hennequine, Dec. 8, 1964. Conveyor belt and table for stacking letters etc. in convenient stacks.

U.S. Pat. No. 2,988,355 Single Letter Feeding Device J. Rabinow June 13, 1961. Swinging tubular arms with vacuum pick-up and stacking.

U.S. Pat. No. 2,554,578 Envelope Feeding Machine J. R. Lauffer May 29, 1951. Picks up envelopes from conveyor belt by means of rotating cylinder. Has fingers for opening the flaps of the envelopes before printing. A jet of compressed air assists in blowing open the flaps - Adjustable for different envelope sizes.

U.S. Pat. No. 2,554,577 Envelope Feeder J. R. Lauffer May 29, 1951. Picks envelopes from a stack on a table. Uses sprocket wheels and chains to transport envelopes. Fingers on the chain grasp the envelopes by the flap.

U.S. Pat. No. 2,138,343 Feeding Mechanism For Offset Printing Machines. P. H. Durup Nov. 29, 1938. Vertically stacked envelopes. Bottom envelope is pulled out by arms with suction cups and placed on belt carrier.

U.S. Pat. No. 1,854,221 Feeding Mechanism. C. L. Post April 19, 1932. Stacked envelopes in a magazine. Unique finger pulls out flap from bottom envelope. Chains on sprocket wheels moves envelope to printing rollers.

The present invention teaches the construction of a novel envelope feeding mechanism ("Feeder") that is configured as an attachment to a conventional printing press ("Press") press and may in a preferred embodiment be coupled to the press in such a way that it obtains mechanical power and air vacuum from the press. The feeder is uniquely suitable for taking envelopes to be imprinted from one, two or several parallel operating appended feeder trays that feed the press envelopes from each tray simultaneously with each printing cycle. The feeder employs a unique rotating feeder drum ("flywheel") coordinated with a parallel feed roller and a vacuum pick-up arrangement that "grabs" each envelope and places it on conveyor belts that bring the envelopes to the entrance of the printing press. The feeder mechanism, as will be explained in greater detail in the following disclosure, has a unique capability of taking envelopes of almost any shape and size and even envelopes that have been crumbled or mutilated may be handled by the feeder at a very high speed. The feeder is capable of operating unattended for long periods of time due to the fact that the feeding trays are open ended and may be very long so that they may contain large quantities of unprinted envelopes. The feeder, as described, has electronic controls that monitor the feeding process and stops the printing process in case of malfunctions so that the envelope stock is not destroyed or wrongly imprinted or so that unused ink is not smeared over the surfaces of the printing apparatus.

SUMMARY AND OBJECTS OF THE INVENTION

The feeder according to the teachings of the invention is designed to feed one, two or several envelopes into the printing press with each printing cycle, and is capable of maintaining very accurate control of the envelope printing registration and impression over the full speed range of the press. The system is adaptable to many different types of offset presses and requires unique mounting and impression control hardware for each different type of press to which it is adapted.

The feeder may be readily detachable from the press, so that the press, if desired, may be restored to its original condition upon removal of the feeder and operate as originally constructed.

The feeder provides electronic control of the printing impression, and has the capability for appropriately controlling the printing impression such that no printing errors occur. The machine accurately controls the location and speed of the traveling envelope throughout the feeding process. The circuit allows the human press operator to control the printing by means of a control panel, as requied by the orientation and number of envelopes being printed per print cycle. This feeder provides the means for a conventional offset printing press to operate continuously and at high speeds while maintaining highly accurate control of the envelope printing registration and impression for at least two envelopes being printed simultaneously on the same printing surface.

The machine has the capability for maintaining totally independent control of each envelope. This feature allows different size enevelopes to be printed per print cycle while maintaining perfect printing registration for each envelope. If one envelope is to be printed per print cycle, then it can be fed into any location of the printing surface. This feature allows any size envelope to be fed into the press, typically, up to and including a 10" by 13" catalog envelope. The integral construction meets the objects of the machine for (1) accurate and reliable injection of the envelope into the press, (2) excellent envelope printing registration, and (3) most efficient use of the printing surface per print cycle.

FIG. 6 is a fragmentary, vertical side view of the rear section of the feeder with associated linkage at the beginning of a feeding cycle.

FIG. 7 is a fragmentary vertical side view of the rear section of the feeder at an intermediate point in the feeding cycle.

FIG. 8 is a fragmentary detail view of the flywheel with the feed roller and its tensioning mechanism.

DETAILED DESCRIPTION OF THE INVENTION

Conventional impression control on printing utilizes a purely mechanical sensor/feedback system to determine if impression is required for each print cycle. The print impression is required for each print cycle in which (1) the envelope being printed is actually present during single-side operation, or (2) when both envelopes being printed are present during two-side operation. The mechanical sensors in conventional machines are designed to detect one sheet of paper per print cycle and are not capable of detecting two independent envelopes per print cycle. The impression control circuit being disclosed herewith in the preferred embodiment is designed to detect the presence of one or two independent envelopes going into the press per print cycle and to appropriately control the printing impression as specified by a panel of control switches. The electronic control circuit is synchronized with the feeding machine and printing press to provide accurate electronic control of the printing impression. The complete feeding system, machine and circuit, is a significant breakthrough in the offset printing industry by virtue of the new ability to control the printing impression, via a control panel, based on the presence of either of two, or both, independent envelopes traveling into the press per print cycle.

Figures 1, 9:
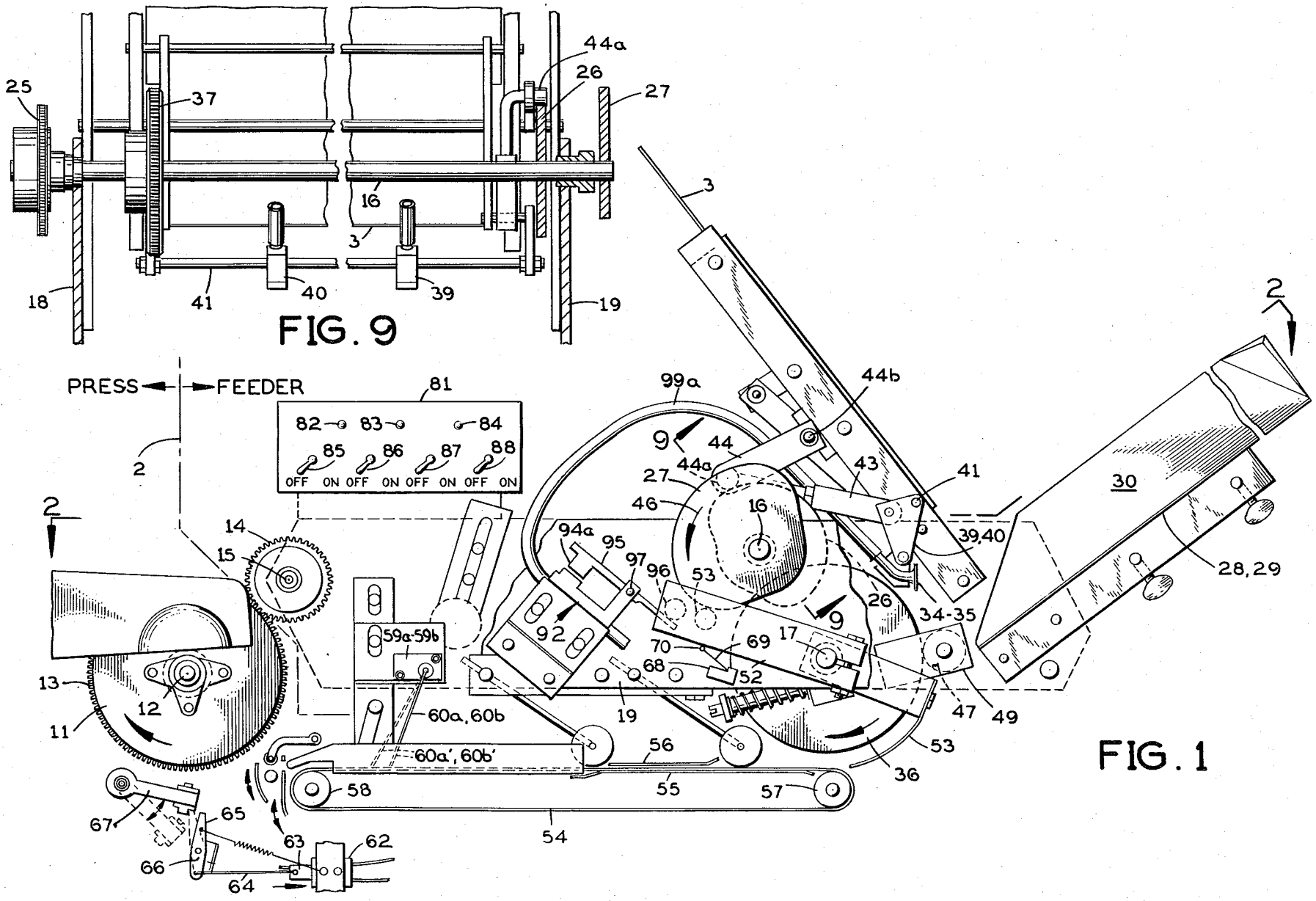
FIG. 1 is a vertical part cross-sectional view of the invention showing its interior construction and elements.
FIG. 9 is a laterally contracted view seen along the line 9—9 of FIG. 1.

FIG. 1 is a vertical part cross-sectional view of the feeder, seen from the right hand side of the feeder. The front side abuts against the printing press ("press") of which only a few details are shown, namely, the so-called blanket cylinder 11 which is rotatable about a shaft 12 and a gear wheel 13 which is in engagement with a corresponding gear wheel 14 in the feeder and provides driving power from the press to the feeder. The stippled line 2 indicates generally the dividing line between the press on the left hand side of the stippled line 2 and the feeder on the right hand side thereof.

The feeder receives its driving power through aforesaid gear wheels 13 and 14 and from the motor that is the primary power source of the press. It follows that the feeder could have its own motor with suitable means for maintaining synchronous operation between the press and the feeder if merited.

The apparatus of the feeder is organized around generally three shaft assemblies, of which 15 is the front shaft, 16 is the upper shaft and 17 is the lower shaft. The construction and operation of the feeder will be explained in reference to these shafts, which are all horizontal, parallel and perpendicular to the plane of the paper. The feeder is shown in a horizontal top-down view in FIG. 2, which also shows the blanket cylinder 11 on its shaft 12, which carries the gear wheel 13 of the press, engaging the gear wheel 14 of the feeder, and which is mounted on the front shaft 15 of the feeder. The apparatus of the feeder is supported between two sturdy, parallel, vertical side plates, the left hand side plate 18 and the right hand side plate 19, which are both seen from the upper edges in FIG. 2. In FIG. 1, the right hand side plate 19 is seen partially in outline in dashed lines, so as not to obscure the interior parts of the feeder. All the rotating shafts of the feeder are supported in bearings that are in turn inserted into the side plates, such as the two bearings 21 and 22 supporting the front shaft 15 at the left and right hand ends respectively, seen in FIG. 2.

The front shaft 15 extends to the left through the left hand side plate 18 and the bearing 22, and carries on its end a driving sprocket wheel 23, which drives, via the drive chain 24 the driven sprocket wheel 25, which in turn drives the upper shaft 16 in counter-clockwise direction viewed from the right hand side as seen in FIG. 1.

The upper shaft 16 carries two rotating cams, the suction control cam 26 and the lower shaft control cam 27, with the suction control cam 26 mounted on the right hand inside end and the lower shaft control cam 27 mounted on the outside end of the upper shaft 16.

Figure 2:
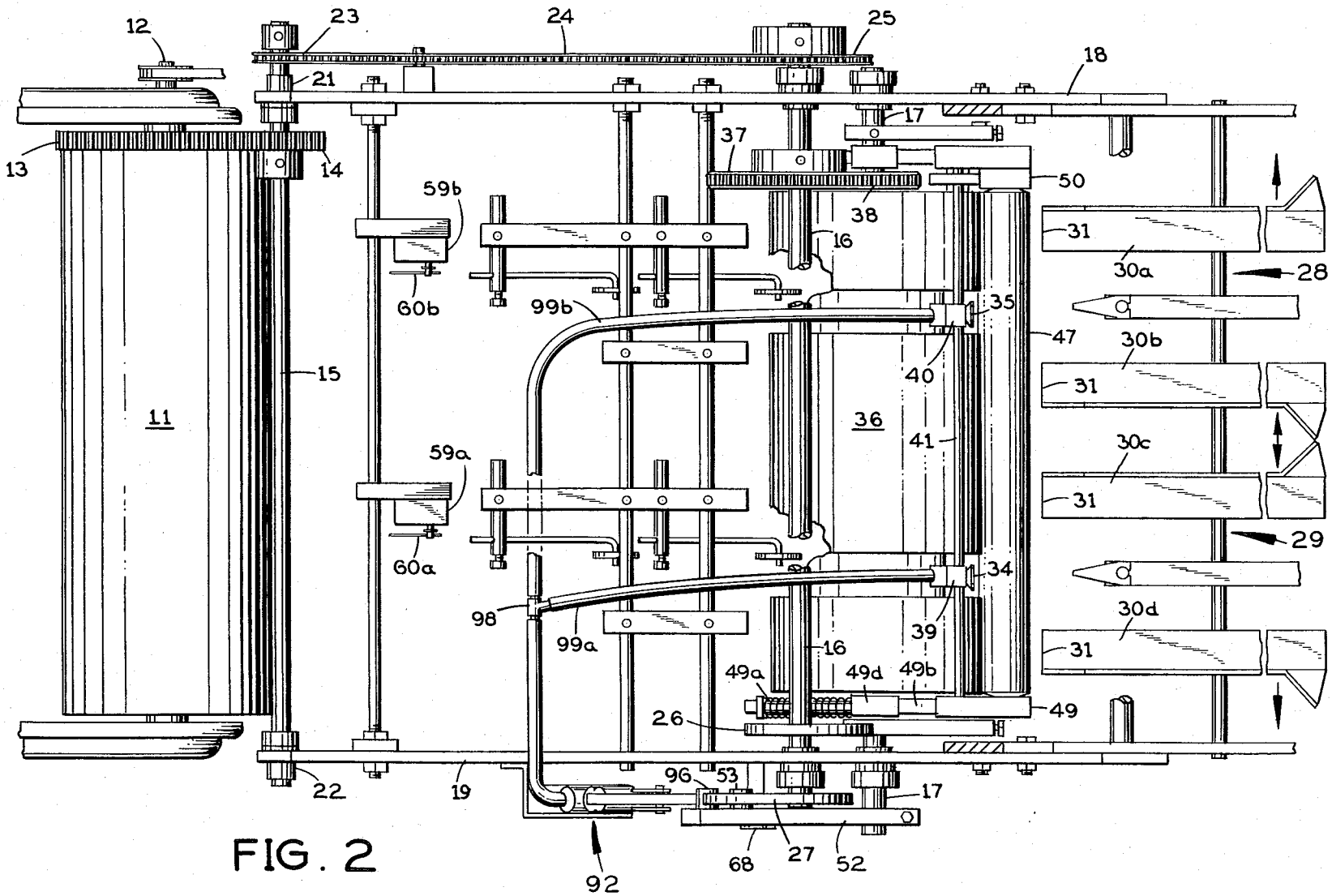
FIG. 2 is a horizontal top-down view of the invention showing its construction and interior elements.

The two cams control and operate the functions performed by the feeder to transport unimprinted envelopes stacked standing generally vertically in the downward sloping feeder trays, the left hand feeder tray 28 and the right hand feeder tray 29, best seen in FIG. 2. FIGS. 6 and 7 show stacks, 32*a* and 32*b* of envelopes contained in the two trays.

Each tray consists of two angle shaped parallel feeder tracks 30*a* and 30*b* forming the left hand tray 28, and 30*c* and 30*d* forming the right hand tray 29. The tracks are adjustable in a sloping plane generally defined by aforesaid feeder tracks 30*a*, 30*b*, 30*c* and 30*d* so that they may accommodate different size envelopes. The details of the adjusting mechanism are conventional and are for the sake of clarity not shown.

The front end 31 of the feeder trays 28 and 29 are open ended toward the front so that the stacks of envelopes can slide forward and downward by the force of gravity, each time the foremost envelope is removed from the stack for printing by the feeder mechanism, as explained in more detail below.

The stacks of envelopes rest with their upper front sides against an upper feed tray 3 FIG. 1 which is a downward sloping plate that serves to stop the downward slide of the stacks of envelopes, best seen in FIG. 6 which shows stacks of envelopes, 32*a* and 32*b*, resting against the upper feed tray 3.

Figure 3:
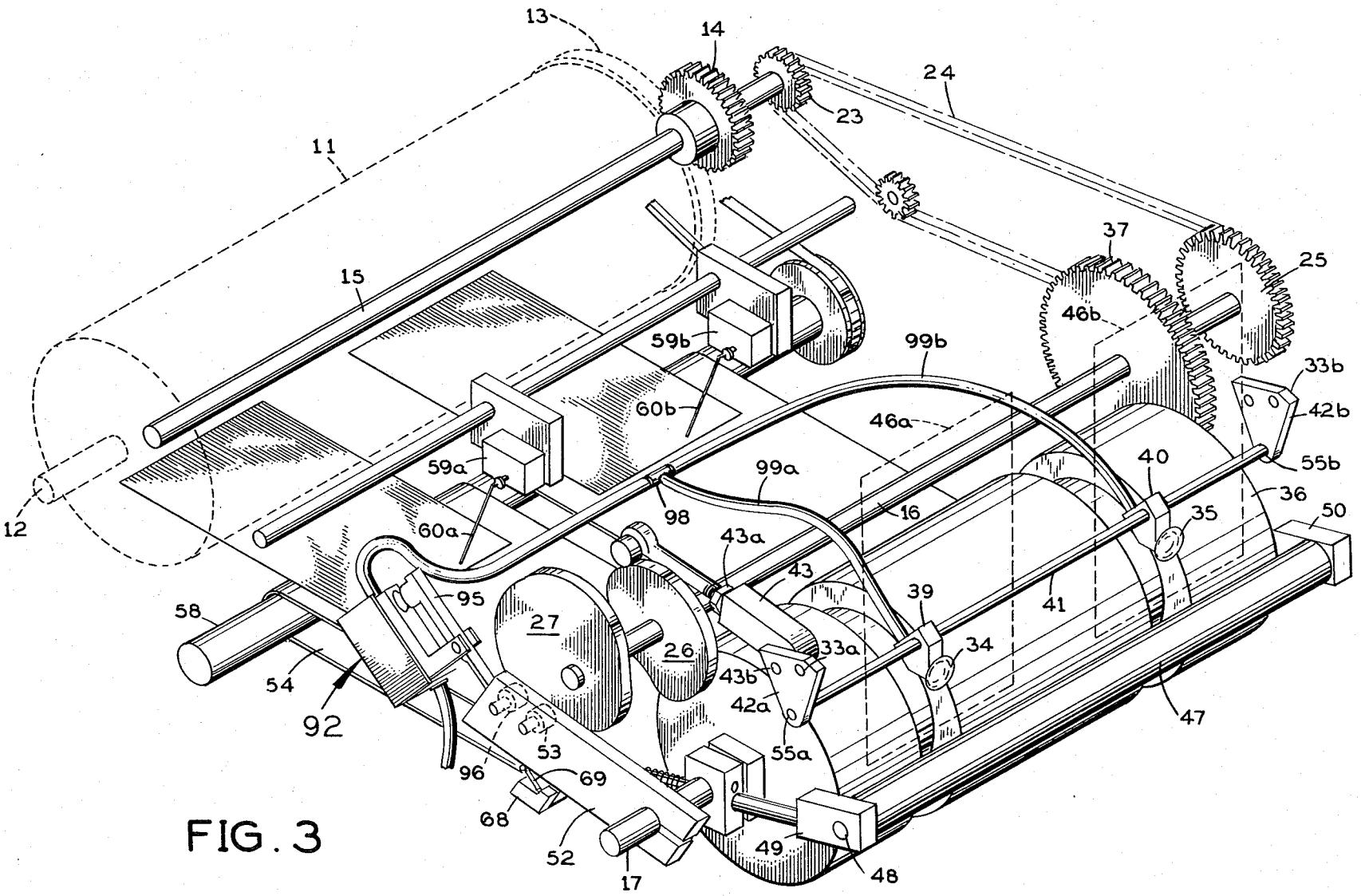
FIG. 3 is a vertical perspective diagrammatic view of the invention showing its principal elements.

The feeder mechanism operates to take an envelope one at a time, from each stack 32*a* and 32*b* in the feeder trays 28 and 29 by means of two pendulously moving suction cups 34, 35, best seen in FIGS. 1 and 3 which in their forward move draws the lower part of the envelopes forward and out of the feeder trays 28, 29 so that the lower edge of the envelopes is bent forward and touches the rotating flywheel 36, which rotates in clock-wise direction about the lower shaft 17. The flywheel 36 is shaped as a cylindrical drum, driven from the upper shaft driving gear wheel 37 which engages the lower shaft driven gear wheel 38, the latter rigidly attached to the flywheel 36 at its left hand end, as best seen in FIG. 2. The flywheel 36 rotates freely about the lower shaft 17 without being attached thereto.

The two suction cups, 34 and 35 (FIGS. 3, 6 and 7) are mounted, facing the rear of the feeder, on two triangular suction cup toggles, 39 and 40, which are in turn rigidly attached mounted through their upper corners to a horizontal toggle shaft 41. The toggle shaft 41 has at its right and left hand ends, rigidly attached to the lower ends 55*a* and 55*b* of two toggle pieces 42*a* and 42*b* respectively that are sloping downward and which are at their upper ends pivotally connected at pivot points 33*a* and 33*b* to the frame of the feeder. A toggle link 43, is pivotally attached at its rear end 43*a* to a pivot point 43*b* on the forward facing edge of the toggle piece 42*a*, and at its forward end, the toggle link 43 is attached at a pivot point 44*a* to a downward and forward facing suction control cam follower arm 44, which is in turn, pivotally, at its upper end 44*b* (FIG. 1) attached to the frame of the feeder. As the suction control cam 26 rotates in counter-clockwise direction, as indicated by the arrow 46, the cam follower 44*a* rolls on the periphery of the cam 26, and causes, via the linkage described above, the suction cup toggles 34, 35 to toggle in an angular, rotary, oscillatory, pendulous motion between an extreme rear position, in which they engage the front surface of the two foremost envelopes 46*a* & *b* (FIG. 3) contained in the two feeder trays 28 and 29, and an extreme forward position, in which they are shown and in which they have pulled, by means of the force of the suction, the envelopes' lower part forward to the position 46*a* and 46*b* wherein they have come to touch the flywheel 36, best seen in FIGS. 3 and 7, and in which the envelopes 46*a* and 46*b* are ready to be "grabbed" by the feed roller 47, as described below. FIG. 3 shows the envelopes 46*a* and 46*b* in dashed outline.

The lower shaft 17, as described above, is disposed horizontally between the side plates 18 and 19 and generally below the upper shaft 16. It supports the flywheel 36 which rotates freely thereon, and it supports a right hand feed roller support arm 49 and a left hand feed roller support arm 50, each rigidly attached to aforesaid lower shaft 17 near its ends inside the side plates 18 and 19. The two feed roller arms extend in parallel generally downward and rearward and support at their distal ends the envelope feed roller 47, which rotates freely about a feed roller shaft 48, which is parallel with the lower shaft 17. The feed roller 47 as best seen in FIG. 8 is a cylindrical, elongated, rubber-coated roller that is pressing with a moderate pressure created by the helical spring 49*a* against the cylindrical surface of the flywheel 36 which urges the feed roller arm 49, mounted on the feed roller shaft 49*b*, through the loosely fitting hole 49*c*, against the surface of the flywheel 36. A washer 49*e* at the distal end of the feed roller arm 49*b* keeps the helical spring 49*a* in a place. The feed roller shaft 49 *b*, received loosely in the hole 49*c*, is drilled through the feed roller support block 49*d* which is, in turn, rigidly attached to the lower shaft 17. The feed roller 47 is capable of moving in an arcuate path defined as a cylindrical sector coaxial with the lower shaft 17 and with the flywheel 36, indicated generally by the dashed line circle sector 51 (FIGS. 6 and 7). FIG. 7 shows the feed roller 47 in its upper position wherein it is just beginning to grab the lower edge of the envelopes 46*a* and 46*b* by pincher action against the flywheel 36. The feed roller is also shown in phantom lines in its lower position 47'.

The rotational movement of the lower shaft 17 is controlled by a lower shaft control arm 52 which is rigidly attached to the right hand end of the lower shaft 17, on the outside of the right hand side plate 19, and adjacent to the lower shaft control cam 27, described above. A lower shaft cam follower 53, in the form of a small rotatable disc is attached to the distal end of the lower shaft control arm 52 and rides on the perimeter of the lower shaft control cam 27. As the cam 27 rotates in counter-clockwise direction with the upper shaft 16 to which it is attached, the lower shaft control arm 52 with the cam follower 53 moves back and forth in an angularly oscillatory motion, thereby turning the shaft 17 being attached thereto, back and forth and in turn causes the two feed roller support arms 49 and 50 to move back and forth in a corresponding angularly oscillatory motion, taking with them the envelope feed roller 47, so that it, as described above, moves in the arcuate cylindrical path indicated by the dashed circle 51 under control of the lower shaft control cam 27. As stated above, in the position shown in FIG. 7 the feed roller has just started its upward motion as it prepares to grab the envelopes 46*a* and 46*b* just brought forward by the suction cups 34 and 35.

The feed roller 47, as it moves upward, grabs the two envelopes 46*a* and 46*b* by their lower edges, as they are pinched between the hard surface of the flywheel 36 and the flexible rubber surface of the feed roller 47, and drives the two envelopes downward against the deflector plate 53 which is curved in such a way that the envelopes are placed onto conveyor belts 54 that run between lower and upper springlike rails 55 and 56. The conveyor belts are endless loops of a suitable rubberized flexible fabric running over the rear belt roller 57 and the front belt roller 58.

The conveyor belts 54 are typically part of the printing press apparatus and are conventional, and need not be described in detail since the invention is not directed to the construction detail of the conveyor per se.

The envelopes moving on the conveyor belt in flat, horizontal position from rear to front, pinched between the conveyor belt proper and the upper rails 56, arrive at the entrance to the printing press and are grabbed there by feeding mechanisms that are part of the press structure. The envelopes, in the press, are imprinted by the method of printing used in the press. Typically the press is a so-called offset press which carries the image to be imprinted in wet ink on the surface of a large, so-called blanket cylinder 11, which transfers it to the envelopes at exactly the place on the envelopes that is to receive the image and wherefrom the envelopes continue through the press and are delivered to a suitable receiving tray.

At the moment the feed roller 47 grabs the envelopes, the suction cups 34 and 35 release their hold on the envelopes. This release is caused by suction control arm 95, which is, in turn, controlled by the lower shaft control cam 27 such that when the lower shaft cam follower 53, attached to aforesaid lower shaft control arm 52 and riding on the perimeter of lower shaft control cam 27, moves downward, the suction control arm actuator 96, which is also attached to the lower shaft control arm 52, moves aforesaid suction control arm 95, pivotably attached to its centrally positioned pivot point 97, and removes the control flap 94*a* from the vacuum valve 92. The control flap 94*a* thereby opens an air hole (not shown) in vacuum valve 92 which is normally covered by the control flap. When the air hole is opened, the force of the suction is removed as air enters the air hole and replaces the vacuum.

In the process of feeding envelopes to the printer, an occasional misfeed may occur or the feeder trays may be depleted, and as a result it can happen that there is no envelope in the press to receive the wet ink image from the blanket cylinder. In such a case the wet ink may be smeared on the wrong surfaces and cause various problems. To prevent the press from attempting to deposit the wet ink if there is no envelope to receive it, the feeder has two envelope sensors 59*a* and 59*b*, which are sensitive micro switches each with a pair of electrical contacts and each with thin, light envelope sensor fingers, 60*a* and 60*b* respectively of thin steel wire attached to the micro switches. The fingers 60*a* and 60*b* activate the switch whenever an envelope in the conveyor belt touches the finger and bends it forward to the position 60'*a* and 60'*b* shown in dashed lines on FIG. 1. This action causes the micro switch contacts to operate, and causes a control circuit 61 connected to the micro switch, to store the fact that an envelope has been detected. The control circuit 61, in turn, causes a printing control arrangement on the press to activate a printing cycle.

The printing control arrangement consists of a solenoid 62 (FIG. 1) with a plunger 63 mounted on the press and is connected via a wire link 64 to one end of an impression control arm 65, which is, in turn, pivotable about a pivot point 66 near the middle of the arm. An impression lever 67 which moves up and down once with each printing cycle is constructed such that in case its downward movement is stopped by the impression control arm 65, it anticipates an envelope in the following printing cycle and prepares to deposit the wet ink image thereon. If an envelope is sensed by the micro switch envelope sensors 59*a* and 59*b* the control circuit 61 operates the solenoid, which pulls in the plunger 63, which, via the wire link 64, pivots the impression control arm, 65, to pivot its upper end into engagement with the impression lever 67, which as a result, starts a printing cycle, as its downward movement is stopped.

The printing control circuit 61 is controlled by a timing switch 68 disposed generally near the lower shaft control cam 27 and has a timing switch finger 69, the end of which, equipped with a small wheel, 70, engages the underside of the lower shaft control arm 52. As the lower shaft control cam 27 rotates in counter clockwise direction, the timing switch 68 is operated once during each revolution of the cam and again once released, so that, due to the shape of the cam, each operation of the timing switch 68 may be used as a timing event, that is, a reference point in timing the operating cycle of the feeder.

The operation of the timing switch 68 enables the control circuit to anticipate the presence of an envelope under sensors 59*a* and 59*b*, and, in case an envelope is not sensed, the impression lever 67 will not be triggered to produce a printing cycle.

Figure 4:
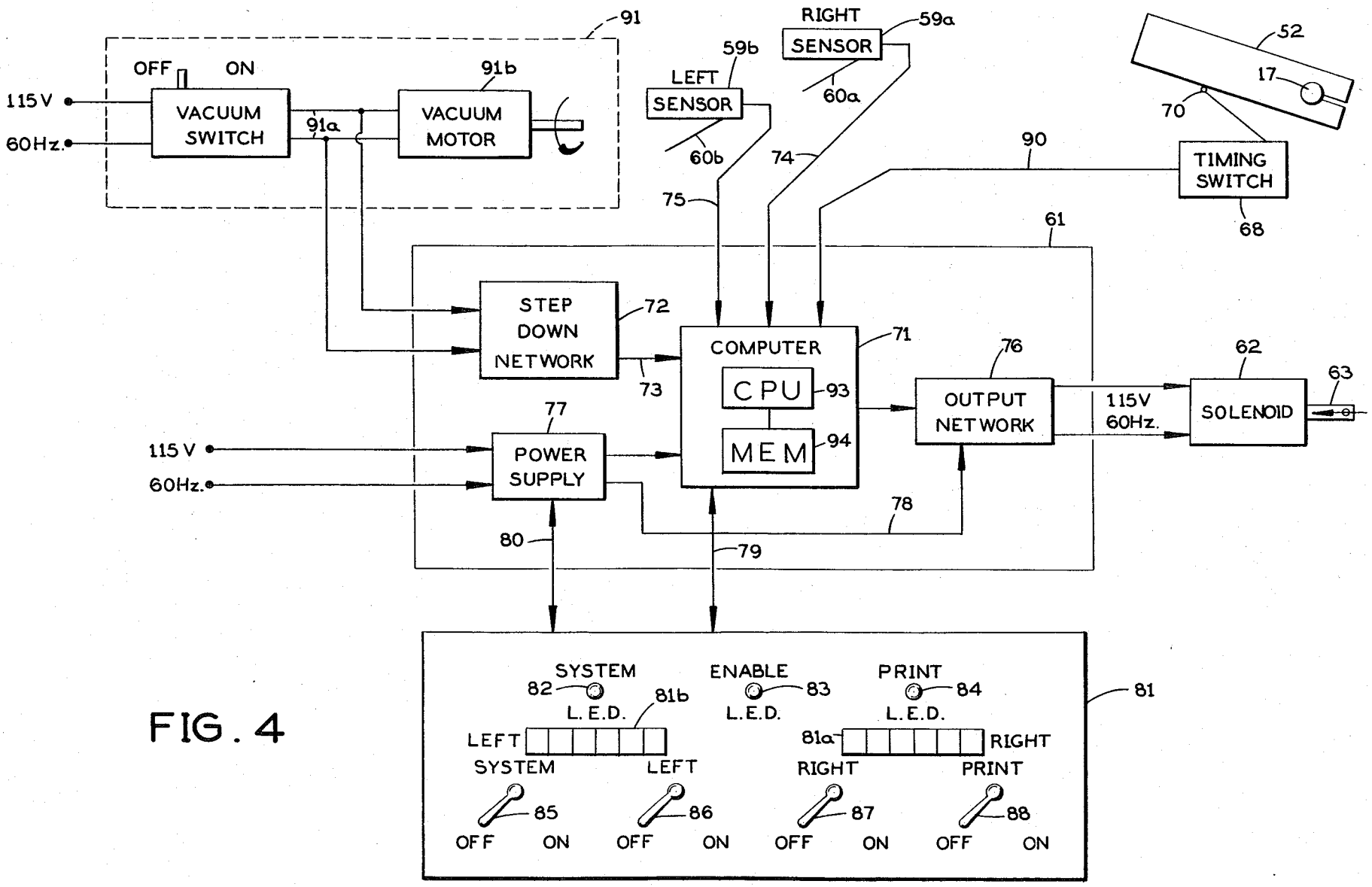
FIG. 4 is a block diagram of the invention showing its electronic control system and the control panel.

The control system is shown in block diagram form in FIG. 4. The main part is the control circuit 61 which contains electronic logic circuits that perform the timing and sensing functions required for the feeder. The controller comprises a computer control which contains a central processing unit (CPU) 93 with memory (MEM) 94 of one of the widely used types, known as a "microcomputer on a chip" component. The CPU used in a working model of the feeder is an Intel type 8748 which contains the processor and memory all in a single component. A step-down network 72 connects the power leads 91*a* to the vacuum motor 91*b* that drives the vacuum pump (not shown). The vacuum switch and the vacuum motor 91 are parts of the press. The step-down network 72 produces, when 115 volt, 60 Hz power is connected to its input side, a positive dc-potential of approximately +5 volts on its output lead 73.

The function of the stepdown network 72 is to inform the CPU 93 that the vacuum motor 91*b* is on, thereby informing the CPU 93 that envelopes should be traveling through the press. When the vacuum motor 91*b* is on (stepdown network activated) the control system will appropriately control the printing impression, provided that the print switch 88 is in the on position. When the vacuum motor is off (stepdown network not activated) the CPU 93 will not activate the solenoid 62, regardless of all other sensors.

The two sensor switches, Right (sensor 59*a*) and Left sensor, 59*b* respectively, produce an output signal of +5 volts dc on the input leads 74 and 75 respectively, when they are operated, indicating presence of an envelope in each side of the conveyor belt 54. The power supply 77 supplies operating power for the entire control 61 and the circuits therein. The output network 76 supplies 115, 60 HZ ac power to the solenoid 62 when all the input conditions that require a printing cycle are satisfied, as described in more detail below.

A control panel 81 is connected with the control circuit 61 and comprises switches and lights required for the operation of the feeder. A System switch 85 with an "on" and an "off" position operates to connect and disconnect electric power to the feeder control circuit 61.

A Left switch 86 with an "on" and an "off" position operates in the "off" position to inform the controller 61 through the left hand envelope sensor 59*b* that intentionally, there are no envelopes in the left hand feeder tray 28 to be printed, while the right hand tray 29 still contains envelopes.

A Right switch 87 also with an "on" and an "off" position operates in a manner similar but complementary to the Left switch 86 described above to inform the system not to anticipate envelopes in the right hand side, when there are no envelopes in the right hand tray to be printed.

A Print switch 88 with an "on" and an "off" position operates through the control circuit 61 to enable the printing function in the "on" position and to disable it in the "off" position, by energizing or not energizing the solenoid 62 in preparation for each printing cycle, as descirbed above.

The control panel 81 further comprises three indicator lights, which preferably are of the light emitting diode type (L.E.D.) now widely used in electronic systems. These light indicators are seen from left to right: System L.E.D., 82, which, when lit, indicates that electric power to the system is on, the Enable L.E.D., 83, and the Print L.E.D., 84.

The function of the enable L.E.D. 83 is to inform the press operator (human) that the print switch 88 and the vacuum motor 91*b* are "on" (both are activated). The enable L.E.D. 83 does not depend on print cycles. The enable L.E.D. 83 is off (not illuminated) when either the print switch 88 or the vacuum motor 91*b* are "off" (not activated). Obviously if the enable L.E.D 83 is on (illuminated) then the press and the feeding system should be printing envelopes. The print L.E.D. 84 is on (illuminated) for each print cycle in which the solenoid 62 is activated, thereby being illuminated for each print cycle in which the printing impression is activated (i.e.—envelopes are being printed). The print L.E.D. 84 is off (not illuminated) for each print cycle in which the solenoid 62 is not activated (i.e.—envelopes are not being printed).

The central processing unit (CPU) 93 with its associated memory 94 contains the controlling logic functions of the control system. The logic functions consist of control programs stored in the form of binary digitally encoded instructions in the memory. These instructions are read and interpreted by the CPU, which in turn performs the sequences of operations and the decisions that are the main function of the controller. The construction of logic control circuits and control programs is a well known art and is described in many instructional books on the subject such as *Microcomputer-Based Design* by John B. Peatman, published by McGraw-Hill Book Company, and having ISBN Number 0-07-049138-0, and need not be described here, since the invention is not directed to construction of such matters. The construction of the electronic logic circuits and the control program is undertaken on the basis of a so-called flow-chart which is a step-by-step description of the sequence of events that govern the operation of the feeder.

Figure 5:
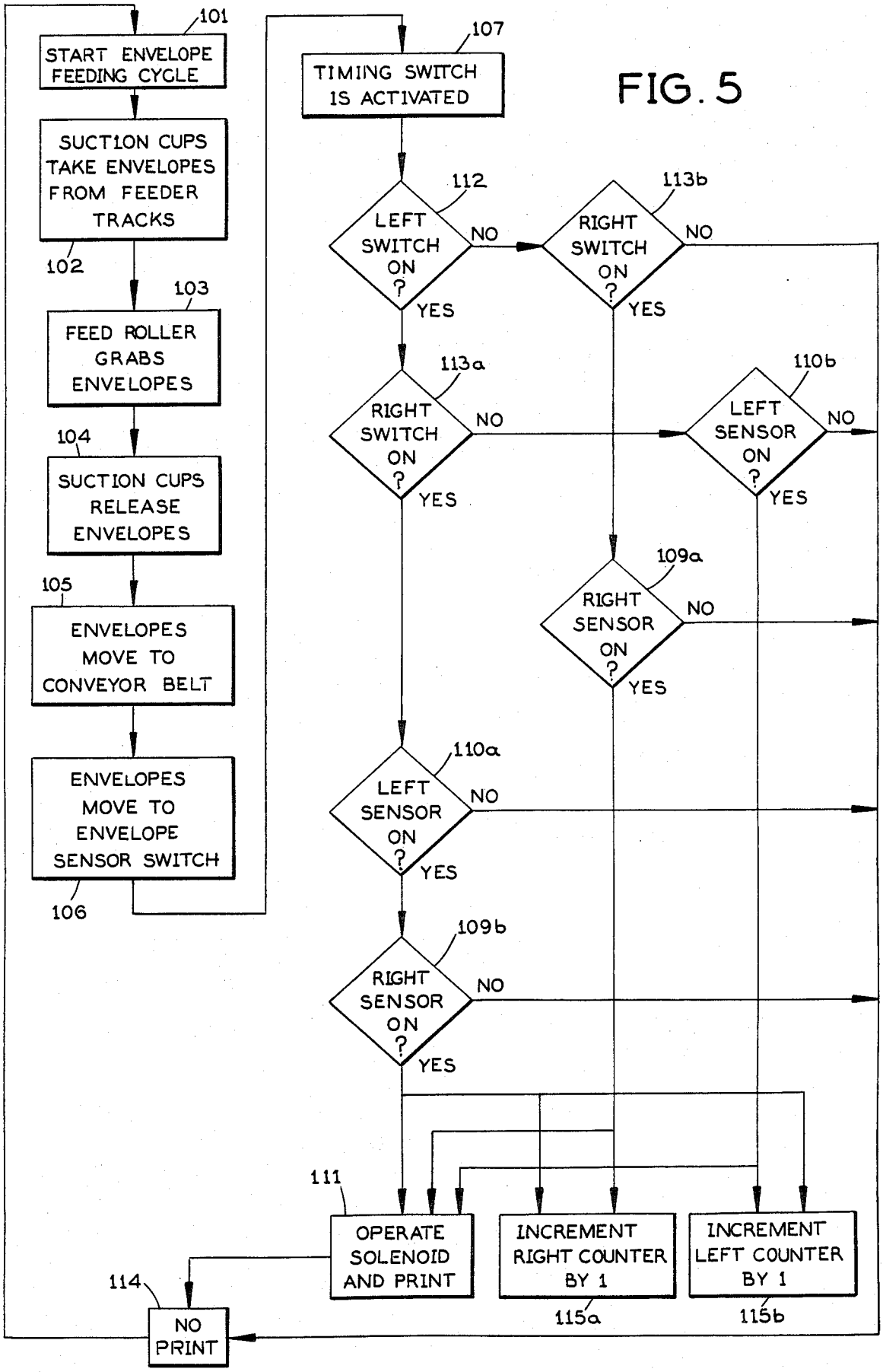
FIG. 5 is a flow-chart diagram showing, step-by-step, the sequence of operations of a feeding and printing cycle.

FIG. 5 is such a flow chart of the operation of the feeder. Before describing the details of the operation and the flow-chart, the following terminology used in describing the operation of the cams should be understood: Each of the two cams, the suction control cam 26 and the lower shaft control cam 27 operate a cam follower which is attached to an arm. Each cam is configured such that its perimeter follows one of the two circular tracks, called the inner and the outer track. It follows that the inner and the outer tracks are connected by short transitional curved tracks so that, as the cam turns, the cam follower in tracing the cam perimeter, moves at a measured rate, but quickly from one track to the other. The operation of the two cams is conventional in all respects.

OPERATION

The operation of the envelope feeder according to the teachings of the invention is best described by means of the flow-chart shown in FIG. 5. The flow-chart embraces the major steps entailed in a complete cycle of the feeder. In step 101, the feeder system is started and is operating, driven by the motor in the printer. In step 102, the suction cups 39 and 40, attached to the toggle shaft 41, under control of the suction control cam 26, and the connecting linkage consisting of the suction control cam follower arm 44, riding with its cam follower 45 on the outer perimeter of suction control cam 26, the toggle links 43*a* and 43*b* and the toggle arms 42*a* and 42*b* (FIGS. 1, 6 and 7), swing toward the stacks of envelopes 32*a* and 32*b* in the feeder trays 28, 29. At the same time, the lower shaft control cam 27 is in such a position that the vacuum valve 92 with its control flap 94*a*, under control of the lower shaft control cam 27, is closing the air hole (not shown) in the vacuum valve 92, and vacuum is extended from the printing press' vacuum valve 92, and vacuum is extended from the printing press' vacuum system through the tube 97 (best seen on FIG. 3) the T-piece 98, the two parallel tubes 99*a* and 99*b* to the suction cups 34 and 35.

In the next step 103, the feed roller 47, under control of the lower shaft control cam 27, moves up, as described above, and grabs the envelopes by their lower edges and transfers them to the conveyor belt in step 105. As the feed roller 47 grabs the envelopes, the suction cups 34 and 35 release their hold on the envelopes, controlled by the lower shaft control cam 27 as explained above.

In the next step 106 the envelopes move toward the envelope sensor switches 59*a* and 59*b* and each sensor switch operates if an envelope is present in the track corresponding with each sensor switch, and in step 107 the timing switch is activated and probes for presence of envelopes in the proper location on the conveyor.

The process of probing for presence of envelopes is shown in the steps indicated by the decision diamonds or points shown in the figure. The path from step 107 leads to decision point 112 which probes the state of the left switch 86. If it is on, the path continues via 112 YES to decision point 113*a* that probes for the state of the right switch 87. In step 113*b*, if the right switch is not on, the path leads via 113*b* NO to step 114 indicating No Printing, which in turn leads to the beginning of a new printing cycle at step 101. In step 113*a*, if the right switch 87 were on, the next step would be step 110*a* which probes if the left sensor 59*b* is on. If the answer to step 110*a* were NO, the path would lead to No Print 114 and a new cycle; if the answer to step 110*a* were YES, the path would lead to decision point 109*b* that probes the state of the right sensor 59*a*, which if not on would lead to step 114, but if step 109*b* were YES, it would lead to step 111, Operate Solenoid and Print, and a printing cycle would be performed. Step 109*b*, YES would also lead to steps 115*a* and 115*b* which would increment both counters 81*a* and 81*b*.

Returning now to step 113*b*, if the right switch 87 had been on, the path would lead to decision point 109*a* via 113*b*, YES, and from here , if the right sensor 59*a* were on, the path would continue via 109*a*, YES to step 111, Operate Solenoid and Print and also to step 115*a*, to increment the right counter 81*a* by one.

Returning to step 110*b*, Left Sensor On, if the answer were YES, the path would continue via 110*b*, YES to step 111, Operate Solenoid and Print, and also to step 115*b*, Increment Left Counter By One. If the answer to 110*b* had been NO, the next step would have been step 114, No Print.

As described above, all operating conditions would be controlled by the feeder controls.

In another optional embodiment of the invention, the step 114 could be combined with an alarm indicator to indicate a misfeed.

In still another embodiment the mechanical counter normally provided on a feeder would be replaced with electronic counters 81*a* and 81*b* with numeric counter displays on the control panel. It follows that the electronic counters could be arranged so that for each printing cycle, the counters would be incremented from steps 115*a* and 115*b*. The operation of the counters would be such that there would be one 6 digit counter (L.E.D. display) for each envelope sensor, i.e.—two 6 digit counters. Each counter would be incremented independently of the other. The function of the electronic counters is described by the flow chart diagram, FIG. 5. The location of each counter display would be on the control panel, as shown in FIG. 4.

In the foregoing description the feeder has been described using two parallel operating feeder trays, each containing envelopes to be imprinted. Each tray may feed a size and shape of envelopes that may be the same or different from the size and shape of envelopes in the other tray. It follows that the invention in principle may not be limited to just two feeder trays, but any number of parallel operating feeder trays could be provided. In present day standard printing practice, however, two feeder trays appear to be the most practical arrangement.

The feeder, as disclosed, is capable of feeding envelopes into a press and to maintain accurate control of the envelope printing registration and impression at speeds ranging typically from 1,000 to 12,500 printing cycles per hour. The conventional printing presses to which this system is typically adaptable operate at speeds typically between 2,500 and 9,500 printing cycles per hour. As described, the feeder is synchronized with the press and may exceed the speed specification of most conventional presses. The feeder is, due to its novel construction, capable of operating at high speeds for extended periods of time.

It is to be understood that the invention is not limited in its application to the details of the particular arrangement shown, since the invention is capable of other embodiments. Also, the terminology used herein is for the purpose of description and not of limitation.

I claim:

1. An envelope feeder for a printing press having gearwheels in the printer interconnected with a gearwheel in the feeder, the feeder which comprises:

at least two feeder trays for holding envelopes to be printed, said feeder trays having an upper end for feeding envelopes into said feeder trays and a lower end for removing envelopes for printing from said feeder trays, suction cup means coordinated with said feeder trays and movable in timed relationship with said printing press in an oscillatory motion between a rear position for engagement with envelopes to be removed by said suction cup means from said lower end of said feeder trays and a forward position for delivery of said envelopes from said forward position to feed roller means, operating in timed relationship with said suction cup means to engage said envelopes, when said suction cup means is in said forward position, and to grab said envelopes in a pinching operation between said feed roller means and a flywheel, said flywheel cooperating in timed relationship with said feed roller means to transport said envelopes to the feeding entrance of said printing press, timing means for timing operation of said suction cup means, said feed roller means and said flywheel in timed relationship with said printing press, means for providing suction, and means for providing operating power for said envelope feeder;

a feed roller, feed roller control means, said feed roller control means operatively engaging said feed roller such that said feed roller moves with its axis in an orientation that is constantly parallel with the axis of said flywheel, said feed roller axis describing an angularly oscillatory arcuate path defined as a sector of a cylinder, said sector coaxial with said flywheel such that said angularly oscillating movement is timed responsively with said timing means.

2. An envelope feeder as recited in claim 1 wherein said feeder trays are independently laterally adjustable such that each of said feeder trays may contain stacks of envelopes of different sizes and different shapes in different feeder trays.

3. An envelope feeder as recited in claim 2 wherein said feeder trays are upward open-ended so that unprinted envelopes may be added to the feeder trays without interrupting the feeding operation.

4. An envelope feeder as recited in claim 1 wherein said suction cup means further comprises:

at least two suction cups with at least one suction cup coordinated with each feeder tray, suction cup linkage operatively engaging said suction cups to move said suction cups in an oscillatory motion between said rear position and said forward position, said mechanical linkage operatively responsive to said timing means.

5. An envelope feeder as recited in claim 4 wherein said suction cup means further comprises:

a suction control cam, said suction control cam operatively responsive to said timing means and operatively engaging said suction cup linkage in timed relationship with said printer.

6. An envelope feeder as recited in claim 4 wherein said suction cup means further comprises tubing, said suction cups operatively communicating with said means for providing suction via said tubing.

7. An envelope feeder as recited in claim 6 further comprising:

a vacuum valve interposed in said tubing between said means for providing suction and said suction cups, said vacuum valve operatively responsive to said timing means to release said envelopes at the time said envelopes commence engagement with said feed roller means.

8. An envelope feeder as recited in claim 1 wherein said feed roller control means further comprises a lower shaft control cam and lower shaft control cam linkage interposed between said lower shaft control cam and said feed roller, said lower shaft control cam operatively responsive to said timing means, said control cam operatively engaging said lower shaft control cam linkage and said feed roller such that said feed roller engages said envelopes at the time said envelopes are in said forward position.

9. An envelope feeder as recited in claim 8 wherein said feed roller is coated with a resilient rubberlike coating.

10. An envelope feeder as recited in claim 8, wherein said feed roller is urged against the surface of said flywheel by means of springs operatively engaging said feed roller.

11. An envelope feeder as recited in claim 1 wherein said timing means further comprises mechanical rotary linkage in engagement with the rotary linkage of the printer in a non-stopping connection.

12. An envelope feeder as recited in claim 11 wherein said timing means further comprises:

a timing switch coordinated with and operatively responsive to said mechanical rotary linkage to produce a timing event for each printing cycle, electronic timing means operatively responsive to said timing event, and operating to timely detect the presence in a given location of envelopes on the conveyor belt, at least two envelope sensing switches with at least one sensing switch for each feeder tray, said sensing switches operatively responsive to the presence of envelopes disposed at said timely detected location on said conveyor belt, logic control means responsive to said electronic timer and to said envelope sensing switches, printer control means operatively responsive to said logic control means such that non-presence of any envelope in any of said timely detected locations on said conveyor belt operates to inhibit the next following printing cycle.

13. An envelope feeder as recited in claim 12 further comprising a control panel, said control panel further comprising sensor control switches and control lights, said sensor control switches operatively manually engaging said logic control means to disengage any one of said envelope sensing switches, when the feeder tray cooperating with any of said envelope sensing switches is intentionally left unloaded.

14. An envelope feeder as recited in claim 13 wherein said indicator lights further comprise lights operating to indicate faulty operation of the feeder.

15. An envelope feeder as recited in claim 12 wherein said logic control means is responsive to the simultaneous occurrence of (a) an envelope not being sensed at its timely detected position on the conveyor belt and (b) said cooperating sensor control switch is set to anticipate an envelope in said timely detected position, said logic control means operating to inhibit the next following printing cycle when said simultaneous occurrence of said (a) and said (b) is encountered.

16. An envelope feeder as recited in claim 12 wherein said logic control means further comprises:

a micro processor, an electronic memory, said micro processor coordinated with said electronic memory and a control program stored in said electronic memory.

17. An envelope feeder as recited in claim 15 further comprising an alarm indicator, said alarm indicator producing a visual and/or an audible alarm in case of the simultaneous occurrence of said (a) and said (b).

18. An envelope feeder as recited in claim 1 wherein said means for providing suction and said means for providing operating power for said envelope feeder are provided through coupling with the suction and power supply for said printing press.

19. An envelope feeder as recited in claim 18 wherein said coupling is detachably releasable by removing said feeder from said printing press.

20. An envelope feeder as recited in claim 13 further comprising at least two envelope print counters operatively coupled to said logic control means and each counter coordinated with a corresponding one of said sensor control switches such that each counter is incremented by one for each envelope printed under control of said coordinated sensor control switch.

21. An envelope feeder for a printing press having gearwheels in the printer interconnected with a gearwheel in the feeder, the feeder which comprises:

at least two feeder trays for holding envelopes to be printed, said feeder trays having an upper end for feeding envelopes into said feeder trays and a lower end for removing envelopes for printing from said feeder trays, suction cup means coordinated with said feeder trays and movable in timed relationship with said printing press in an oscillatory motion between a rear position for engagement with envelopes to be removed by said suction cup means from said lower end of said feeder trays and a forward position for delivery of said envelopes from said forward position to feed roller means, operating in timed relationship with said suction cup means to engage said envelopes, when said suction cup means is in said forward position, and to grab said envelopes in a pinching operation between said feed roller means and a flywheel, said flywheel cooperating in timed relationship with said feed roller means to transport said envelopes to the feeding entrance of said printing press, timing means for timing operation of said suction cup means, said feed roller means and said flywheel in timed relationship with said printing press, means for providing suction, and means for providing operating power for said envelope feeder.

* * * * *